US009961979B2

(12) United States Patent
Rodrigues

(10) Patent No.: US 9,961,979 B2
(45) Date of Patent: May 8, 2018

(54) HAIR DRYER WITH CONTROL SWITCHES UNDERNEATH HANDLE

(71) Applicant: Oscar Jose Rodrigues, Weston, FL (US)

(72) Inventor: Oscar Jose Rodrigues, Weston, FL (US)

(73) Assignee: Oscar Rodrigues, Miami, FL (US)

( * ) Notice: Subject to any disclaimer, the term of this patent is extended or adjusted under 35 U.S.C. 154(b) by 395 days.

(21) Appl. No.: 13/633,339

(22) Filed: Oct. 2, 2012

(65) Prior Publication Data

US 2014/0090266 A1 Apr. 3, 2014

(51) Int. Cl.
*A45D 20/12* (2006.01)

(52) U.S. Cl.
CPC ..... *A45D 20/12* (2013.01)

(58) Field of Classification Search
CPC ..... A45D 20/10; A45D 20/12
USPC ..... 34/96–100
See application file for complete search history.

(56) References Cited

U.S. PATENT DOCUMENTS 4,646,003 A * 2/1987 Phillips et al. ..... 324/74
5,101,191 A * 3/1992 MacFadyen et al. ..... 375/259
7,532,987 B2 * 5/2009 Matsubayashi et al. ..... 702/60
8,050,001 B2 * 11/2011 Crucs ..... 361/42
9,474,347 B2 * 10/2016 Pedroarena ..... A45D 20/12
2005/0048337 A1 * 3/2005 Matsubayashi et al. ..... 429/23
2009/0165811 A1 * 7/2009 Zimmerman ..... 132/203
2010/0045427 A1 * 2/2010 Boone et al. ..... 340/5.23
2014/0028323 A1 * 1/2014 McGuire et al. ..... 324/508
2014/0090266 A1 * 4/2014 Rodrigues ..... 34/97

FOREIGN PATENT DOCUMENTS

EP 2684482 * 2/2014
WO WO 2010045698 A1 * 4/2010 ..... A45D 20/12

* cited by examiner

*Primary Examiner* — Stephen M Gravini

(57) ABSTRACT

"Hair Dryer with control switches underneath handle" (1) consisting of external body (2), provided of cable (2*a*), wire (3) and buttons/switches (4), and internally, engine (5), electrical resistance (6) and internal cabinet (7) that delimits heating air chamber (8), aforementioned cabinet (7) extending frontally out in short nozzle (7*a*), said hair dryer (1) incorporating digital hour counter ("hour meter") (9associated with the appliance's engine (5), and presenting its buttons/switches (4) moved to the bottom (10) of the cable (2*a*), being provided cold air flow system, configured by spacing (11) and (12) that delimit cold air input and output, creating a cold air flow around and along the entire length of the outer surface of the internal cabinet (7), which isolates this latter of the inner surface of the body (2).

1 Claim, 4 Drawing Sheets

Det. A

Det. B
Det. B
Det. B
1
2
2a
3
4
5
6
7
7a
8
11
12

HAIR DRYER WITH CONTROL SWITCHES UNDERNEATH HANDLE

This patent is related to a provisional patent filled on Jul. 7, 2012, application No. 61/669,028. This patent of invention relates to a new hair dryer, which features a number of innovative characteristics not provided in the technical known models and currently marketed, thus constituting a differentiated product, constructive and functionally advantageous compared to usual, and it deserves, therefore, the protection of a privilege.

Prior art shows household appliances generally marketed with a respective guarantee certificate, which is a document issued by the manufacturer and delivered to the consumer together with the product invoice, to provide, in case of manufacturing defects, a total guarantee for a certain period of time, covering the appliance repair and/or replacement of its components, or even the complete replacement of the appliance itself.

With respect to hair dryers, typically this warranty is given for a period of 6 (six) months.

It happens that, in the case of hair dryers, the guarantee should be related not to a particular time period, but to the number of hours of effective use of the appliance. In fact, there are consumers who use their hair dryer sporadically, others who use it daily, and even others, who use it several times a day (as is the case of professional hairdressers).

This causes some problems for both consumers and manufacturers. In fact, being the guarantee stipulated in 6 (six) months from date of appliance purchase, consumers who use hair dryer less frequently often only realize the occurrence of some defect in the appliance after the end of its warranty period, precisely on the basis of infrequently use of the appliance; on the other hand the consumers who use hair dryer every day or several times a day, since they keep it working almost continuously, with very few and short interruptions, overload too much the appliance's engine, being, in these cases, used the guarantee several times within that period of 6 (six) months, causing inconvenience to the manufacturers.

Thus, it would be more fair and appropriate, for both consumers and manufacturers, that the guarantee of the hair dryers were determined on the basis of hours of effective use, regardless of the date of its purchase.

To make this possible, the Applicant devised this new hair dryer, whose first innovative characteristic is a digital hour counter ("hour meter") associated with the appliance's engine, and installed anywhere in the body of the hair dryer. In this way, this hour meter will indicate hours continuously and permanently the number of operation hours, so as to enable the provision of guarantee certificates associated with the effective use of it, regardless of the date of acquisition of the hair dryer by the consumer.

Also as we all know, the hair dryers known and marketed on the market so far present their on/off buttons and their air intensity and temperature switches located on the side of its cable, being unwanted obstacles to handle the appliance, often interfering and even making more difficult its use.

In order to solve this inconvenient, the Applicant devised this new hair dryer, whose second innovative characteristic is the fact that it has their buttons and switches moved to the bottom of the handle, improving the ergonomics of the appliance, and providing the user with a better and more comfortable handling of the hair dryer.

Even another drawback noted in hair dryers prior art consists in the occurrence of an excessive heating of the appliance's body during its use, bothering the users; such heating occurs because there is no insulation between the usual internal cabinet of the dryer (which delimits the appliance's heating chamber) and its external body.

In order to solve this inconvenient, the Applicant has created, in this new hair dryer by him devised, a system of cold air flow between the internal cabinet of the dryer (which delimits the appliance's heating chamber) and its the external body, avoiding, thus, the excessive heating of the dryer, such configuration consisting a third innovative characteristic of the hairdryer, object of this patent.

With all these innovative characteristics, the referred hair dryer results in a differentiated product, constructively and functionally advantageous compared to usual hair dryers, and it deserves, therefore, the protection of an invention patent.

For the purpose presented, there are drawings of this invention attached, through which the appliance can be better viewed:

Figure 1:
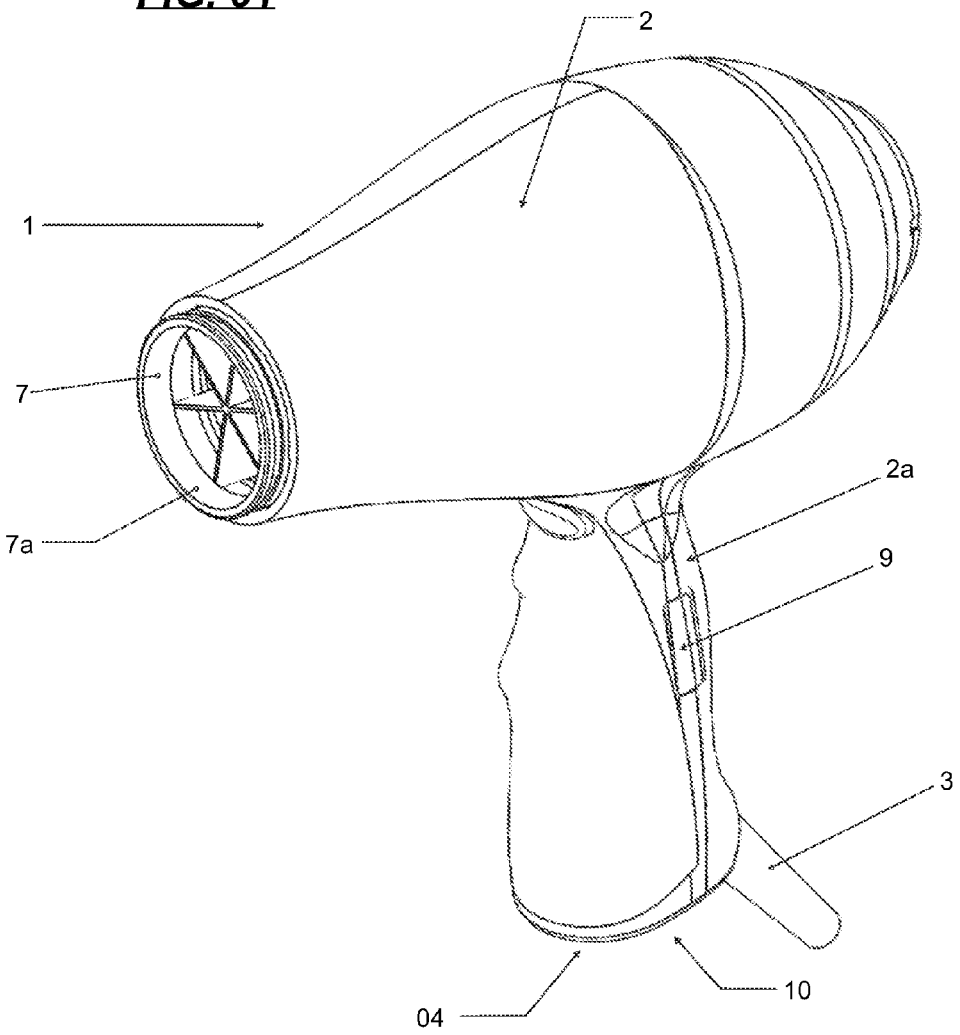
FIG. 1 is a frontal perspective of hair dryer now innovated.
Figure 2:
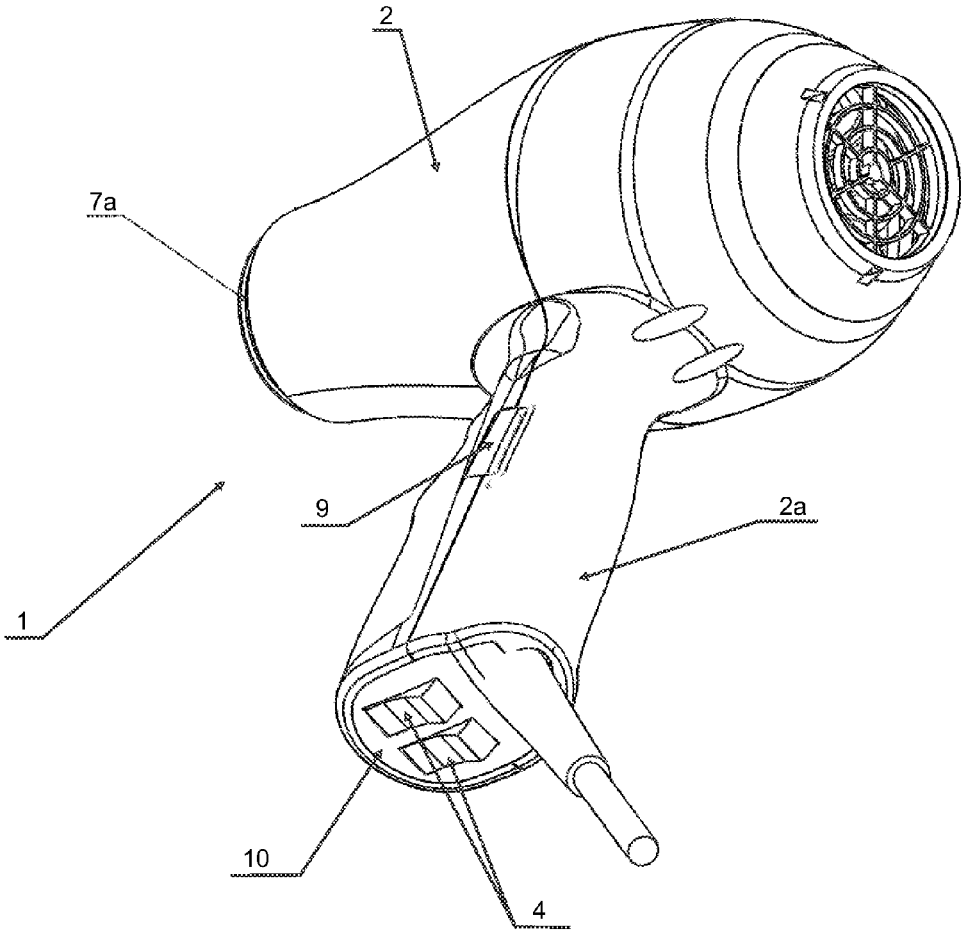
FIG. 2 illustrates the appliance through a postero-inferior perspective.
Figure 3:
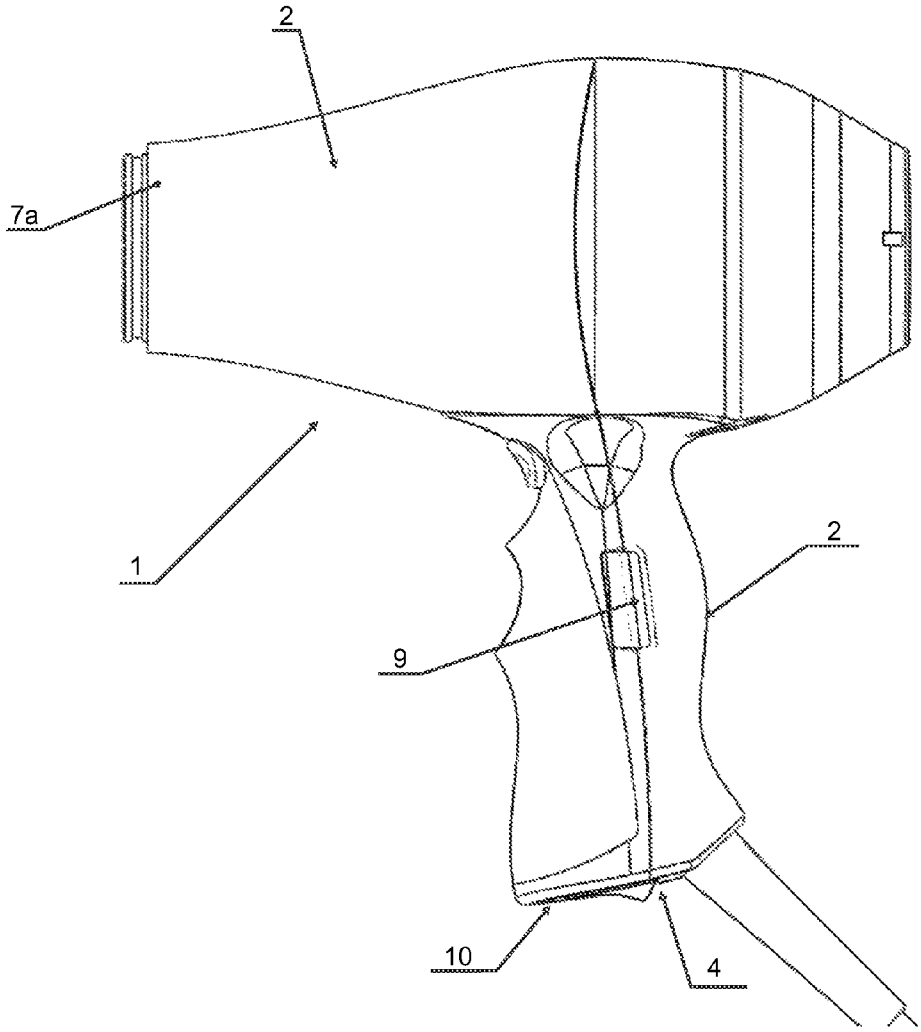
FIG. 3 is a side view of the hair dryer.
Figures 4, 5, 6:
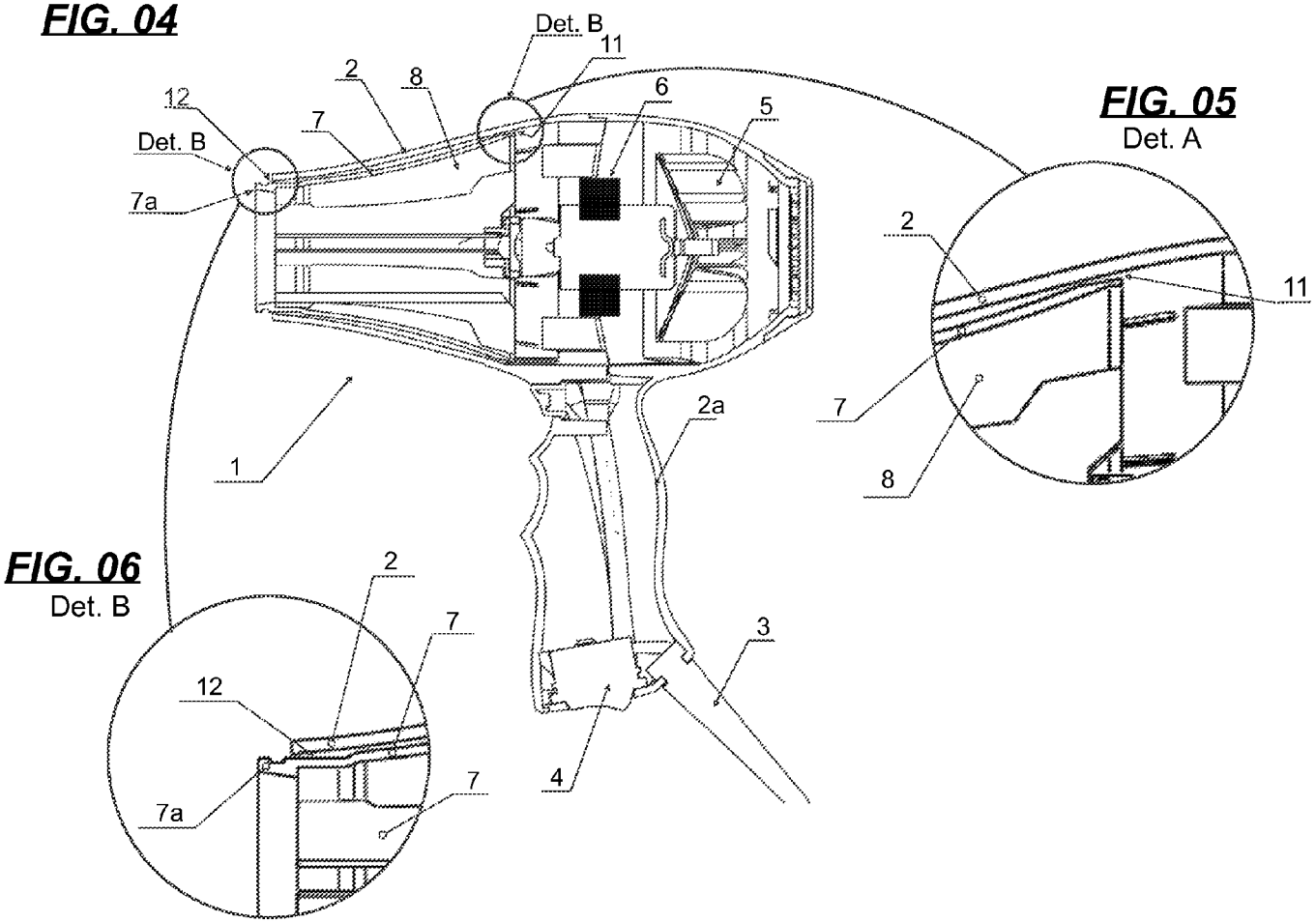
FIG. 4 is a side view on cutting of the hair dryer in question.

FIGS. 5 and 6 are extended details of appliance, respectively indicated in the previous figure by "Det. A" and "Det. B", both illustrating the cold air flow system now innovated.

The object of this invention patent is a "HAIR DRYER", hair dryer (1) with type consisting of an external body (2) provided with handle (2*a*) for handling by the user, cable (3) for power supply and buttons/switches (4) to turn on/off the appliance and to determine the temperature and air intensity, and that internally, aforementioned hair dryer (1) is endowed with engine (5), electrical resistance (6) and internal cabinet (7) that delimits the heating air chamber (8) of the hair dryer, stated cabinet (7) extending frontally out of the body (2), on a short stretch (7*a*) that configures the output nozzle of heating air.

According to this patent, this hair dryer (1) incorporates a digital hour counter ("hour meter") (9) associated with the appliance's engine (5), and conveniently installed anywhere in the body (2) of hair dryer.

As an exemplification, not restrictive, in attached drawings, the hour counter (9) was illustrated in one of the sides of the dryer (1) cable (2*a*), being that by getting the display of this counter (9) on the same plane of the outer face of the said cable (2*a*), the provision of this counter (9) on the side of the cable does not embarrass the handling of it by the user.

Also in accordance with this patent, this hair dryer (1) presents its buttons/switches (4) moved to the bottom (10) of the cable (2*a*), improving the ergonomics of the appliance, and providing a better and more comfortable handling of the hair dryer by user.

And also according to this patent, this hair dryer (1) is provided with a system of cold air flow to cool the body (2) of the appliance, cold air flow system obtained due to spacing prediction (11) and (12) between the outer surface of the internal cabinet (7) and the inner surface of the appliance body (2), next to the back and front ends of the aforementioned internal cabinet (7) (see extended details "Det. A" and "Det. B", illustrated in FIGS. 5 and 6).

In that way, the spacing (11) configures a cold air input, while the spacing (12) configures the output of this same air to the outside, creating thus a cool air flow around and along the entire length of the outer surface of the internal cabinet (7), which substantially isolates the appliance of inner surface of the body (2), and, with this, avoids the excessive heating of the body (2), which bothers a lot the users.

With the innovations now envisaged, it is obtained a series of technical and functional advantages in the hair dryer object of this patent: the hour counter (9) now innovated will indicate continues and permanently the number of operation hours, so as to enable the provision of guarantee certificates associated with the effective use of it, regardless of the date of acquisition of the hair dryer by the consumer; the adjustment of the buttons/switches (4) to the bottom (10) of the cable (2*a*) will allow a more comfortable and ergonomic use of the hair dryer; and the prediction of cold air flow around and along the entire length of the outer surface of the internal cabinet (7) of the hair dryer will avoid substantially the heating of the appliance during its use.

The invention claimed is:

1. "Hair Dryer with control switches underneath handle", hair dryer (1) consisting of an external body (2) provided with cable (2*a*), wire (3) to electric power and buttons/switches (4) to turn on/off the appliance and to determine the temperature and air intensity, and that internally, aforementioned hair dryer (1) is endowed with engine (5), electrical resistance (6) and internal cabinet (7) that delimits the heating air chamber (8) stated cabinet (7), extending frontally out of the body (2), on a short stretch (7*a*) that configures the output nozzle of heating air, characterized by the aforementioned hair dryer (1) incorporates a digital hour counter ("hour meter") (9) associated with the appliance's engine (5), conveniently installed anywhere in the body (2) of hair dryer, and presents its buttons/switches (4) moved to the bottom (10) of the cable (2*a*) of appliance, being provided cold air flow system, configured by spacing (11) and (12) arranged between the outer surface of the internal cabinet (7) and the inner surface of the body (2), along the back and front ends of the internal cabinet (7), the spacing (11) configuring the input of cold air, and the spacing (12) configuring output of this air to the outside, creating a flow of cool air around and along the entire length of the outer surface of the internal cabinet (7), which isolates this latter of the inner surface of the body (2).

* * * * *